US005222456A

United States Patent [19]

Friedrich

[11] Patent Number: 5,222,456

[45] Date of Patent: Jun. 29, 1993

[54] BOAT BOW BOARDING PLATFORM

[76] Inventor: Albert F. Friedrich, 280 Deep Forest La., Defiance, Mo. 63341

[21] Appl. No.: 926,995

[22] Filed: Aug. 10, 1992

[51] Int. Cl.[5] ..... B63B 35/00

[52] U.S. Cl. ..... 114/362; 114/343

[58] Field of Search ..... 114/343, 362, 364; 182/90–92

[56] References Cited

U.S. PATENT DOCUMENTS

| | | | |
|---|---|---|---|
| 3,670,847 | 6/1972 | Mack, Jr. | 182/92 |
| 3,828,707 | 8/1974 | Young | 182/92 |
| 4,142,477 | 3/1979 | Powers | 114/263 |
| 4,146,941 | 4/1979 | Haslam | 182/92 |
| 4,161,795 | 7/1979 | Quest | 9/1.6 |
| 4,293,967 | 10/1981 | Ord | 9/1.6 |
| 4,611,552 | 9/1986 | Koppelomaki | 182/92 |
| 5,085,165 | 2/1992 | Reed | 114/362 |

*Primary Examiner*—Edwin L. Swinehart
*Attorney, Agent, or Firm*—Grace J. Fishel

[57] ABSTRACT

A boarding platform for a boat having a bow eye is useful over a wide range of boat hulls and does not materially interfere with the flow of water over the bow. The bow boarding platform has a Y-shaped mounting bracket and a stage which can be used as a place to stand or as a step. A pivotable connector joins the stage to the mounting bracket in such a manner that the stage can be placed in an upwardly inclined "stow" position and in a generally horizontal "use" position.

12 Claims, 3 Drawing Sheets

BOAT BOW BOARDING PLATFORM

The present invention relates to a boarding platform which can be attached to a bow eye at the front of a boat, which is usable on a wide range of boat hulls and which does not interfere with the flow of water over the bow.

BACKGROUND OF THE INVENTION

Pleasure craft such as motor boats, yachts of various sizes, sail boats and the like, as a rule, are brought in bow first whether at a dock or at a beach or other natural docking area. This is because the bow has the least draught since the stern is usually outfitted with a propeller, keel, rudder or the like that extends some distance beneath the bottom of the boat. Moreover, the risk of damage is less because the boat's bow is usually reinforced and stronger than its stern.

Most pleasure craft are provided with ladders at the back for boarding from the water. No permanent ladder is provided at the front of the boat since it would interfere with the flow of water over the bow. Sometimes a loose ladder is used but there is normally little space on board for storing loose articles. Hence the passenger must choose between going off the back and getting wet or jumping off the front and risking injury. The bow of most pleasure craft is quite high above the water so that getting on from the bow usually requires some assistance.

Various platforms have been proposed for attachment to the bow of a boat for use as boarding steps. These devices have not been entirely satisfactory, however, because there has been no way to fold them up when they are not in use for boarding and they interfere with the flow of water over the bow of the boat. In addition, not all of the boarding platforms are adaptable to boats of different types. This is important since the slope, height and the like of boat hulls varies widely.

SUMMARY OF THE INVENTION

An important object of the present invention is to provide a boarding platform for attachment to the bow of a pleasure craft, which when folded up, does not interfere to any great extent with the flow of water over the bow of the boat. Another object is to provide a boarding platform which can be used with a wide range of boats of different types. Other objects and features of the invention will be in part apparent and in part pointed out hereinafter.

In accordance with the invention, a boarding platform for attachment to a bow of a boat having a bow eye is provided. The boarding platform has a Y-shaped mounting bracket and a stage upon which a passenger can stand or use as a step. There are means for attaching the mounting bracket to the bow eye and pivotable connector means for attaching the stage to the mounting bracket. The pivotable connector means accommodate placement of the stage in an upwardly inclined "stow" position and in one or more generally horizontal "use" positions.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
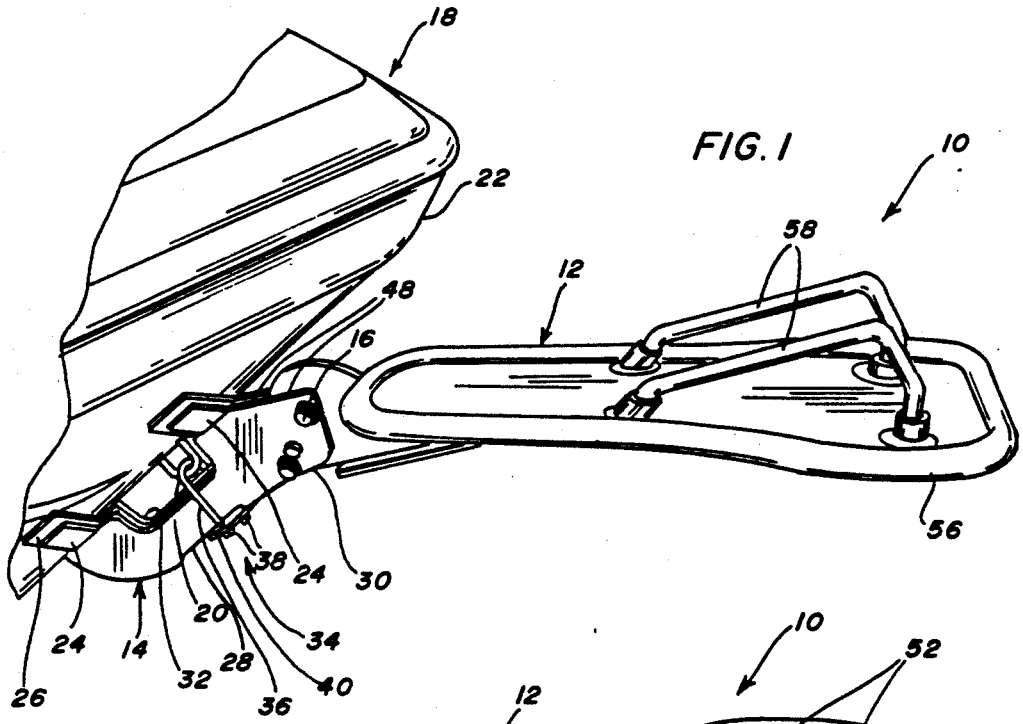
FIG. 1 is a perspective view of a boat bow boarding platform in accordance with the present invention, said boarding platform including a stage and a mounting bracket illustrated mounted on a bow of a boat.
Figure 2:
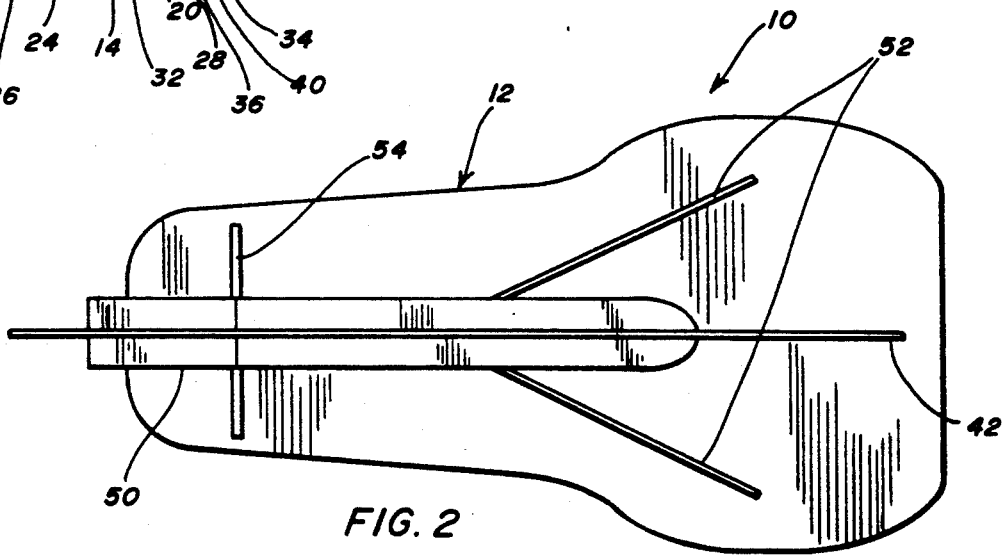
FIG. 2 is a plan view of the boarding platform.
Figure 3:
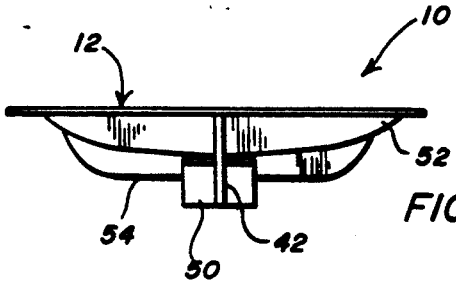
FIG. 3 is a front view of the boarding platform.

Referring to the drawings more particularly by reference character, reference numeral 10 refers to a boarding platform 10 in accordance with the present invention. Boarding platform can be formed of aluminum, plastic or other suitable material. Boarding platform 10 includes in major part a stage 12 and a Y-shaped mounting bracket 14. Stage 12 is attached to mounting bracket 14 through a pivotable connector means 16 which permits stage 12 to be placed in either an upwardly inclined "stow" position or one or more "use" positions including a generally horizontal "use" position. As illustrated, boarding platform 10 is attached to a pleasure craft 18 by means of an existing bow eye 20. Bow eye 20 is provided on a bow 22 for towing the boat, mooring it and for winching it onto a trailer.

Mounting bracket 14 includes a pair of spaced apart arms 24 for cradling bow 22. The included angle between arms 24 is preferably the same or substantially the same as the angle defined by the converging exterior surfaces of bow 22 adjacent bow eye 20. The interior surface of arms 24 is lined with a pad 26 of resilient material for gripping bow 22 and to avoid damaging the boat.

Arms 24 are joined by a leg 28 with a head 30 and with an elongated slot 32 for receipt of bow eye 20. Slot 32 is sized so that mounting bracket 14 has a limited range of movement up and down bow 22 since the placement of bow eye 20 above the water line differs from boat to boat. Slot 32 allows placement of mounting bracket 14 along bow 22 so that stage 12 is spaced not too far below the deck line such that a user can step from the deck onto stage 12.

A means 34 is provided for attaching mounting bracket 14 to bow eye 20. As shown in the drawings, means 34 is a U-bolt 36 with threads and nuts 38 at the end of each leg. The legs of U-bolt 36 are joined by a strap 40 which is secured by nuts 38. The bite of U-bolt 36 is received in bow eye 20 and strap 40 joins the legs. When nuts 38 on U-bolt are tightened, mounting bracket 14 is pressed against bow 22 by strap 40.

Stage 12 is supported on an elongated arm 42, one end of which terminates in an elbow 44 with a pair of lobes 46. Elongated arm 42 is joined by pivotable connector means 16 to head 30 at elbow 44. Leg 28 is preferably formed from a pair of plates 48 with elbow 44 fitting snugly between the plates in the head 30 portion. A flange 50 is attached to elongated arm 42. Stage 12, elongated arm 42 and flange 50 form an I-beam for reinforcing stage 12. Support ribs 52 and a cross brace 54 are attached to elongated arm 42 and to the underside of stage 12 for additional support.

The underside of stage 12 (between elongated arm 42, support ribs 52 and cross brace 54) can be filled with foamed plastic or sheeted over and finished with fiberglass or the like. A rubber bumper 56 is attached to the periphery of the stage. The filling or sheeting and bumper strengthen the stage 12 and improve its physical appearance. A pair of hand rails 58 is provided along the outside side edges of stage 12 and a nonslip surface may be provided on the top surface.

Figure 4:
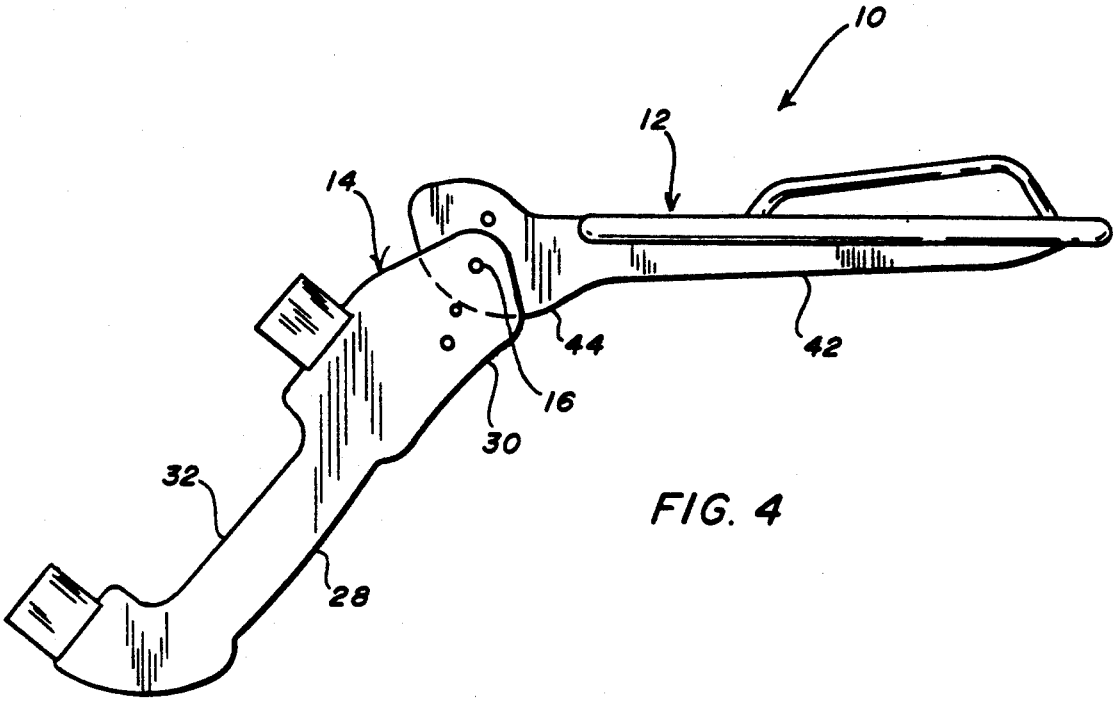
FIG. 4 is a side elevation view showing the boarding platform mounted on the bow of a small boat.
Figure 6:
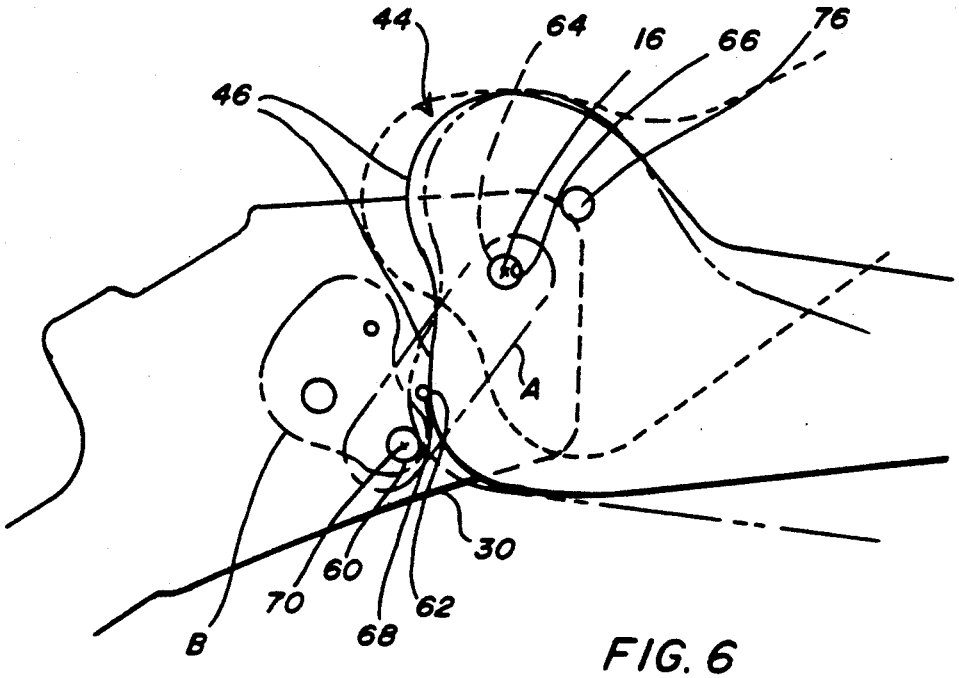
FIG. 6 is an "x-ray" view of a joint connecting the stage to the mounting bracket when the boarding platform is mounted on a small boat as shown in FIG. 4; and, FIG. 7 is an "x-ray" view of a joint connecting the stage to the mounting bracket when the boarding platform is mounted on a large boat as shown in FIG. 5.
Figure 7:
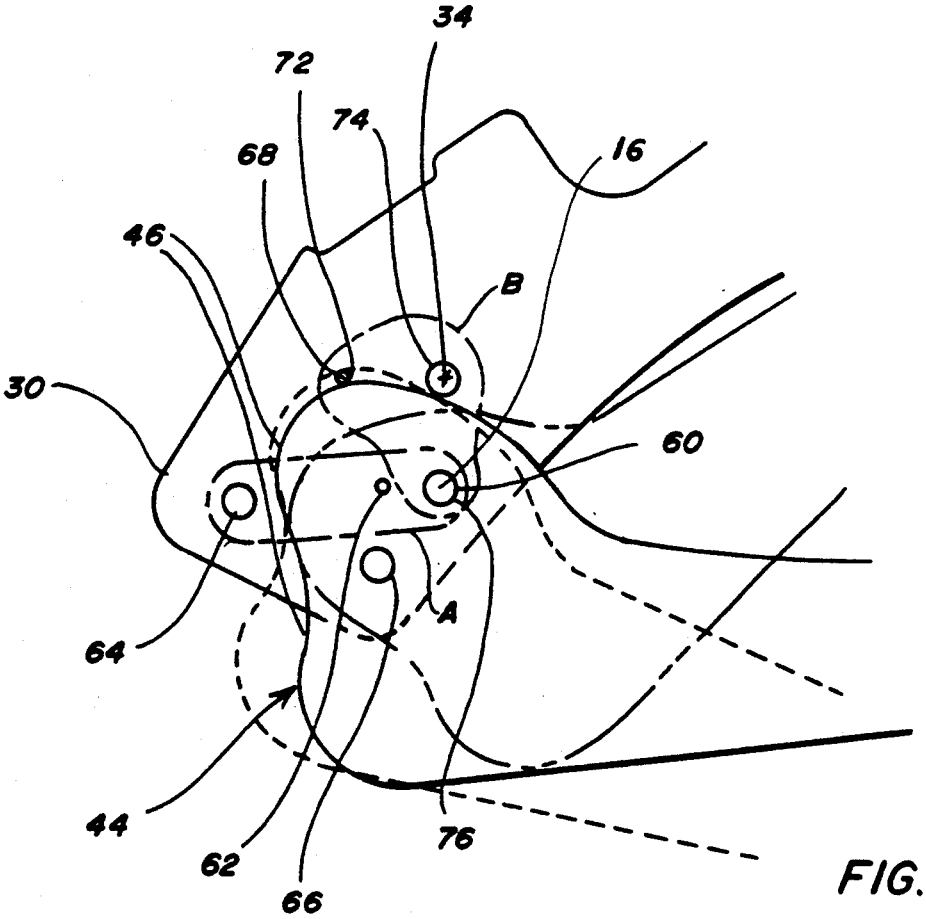

The movement of elongated arm 42 is controlled by a first set of aligned holes in plates 48—namely, holes 60, holes 62 and holes 64 (marked with circle A in FIGS. 6 and 7). With continuing reference to the drawings, pivotable connector means 16 is shown as a pin passing through a pivot hole 66 in elbow 44 of the elongated arm and through holes 64 in plates 48. As illustrated in FIGS. 4 and 6, a stop means 68 (illustrated as a pin passing through holes 62), is provided between plates 48 in head 30 for holding stage 12 in the generally horizontal "use" position. The horizontal "use" position is illustrated in full lines in FIGS. 4 and 6. A connector means 70 passes through holes 60 in plates 48 in head 30 such that leg 28 does not twist at its point of connection to elongated arm 42. When stop means 68 has been pulled as with a pull cord or the like (not shown), the end of stage 12 opposite pivotable connector means 16 can drop below horizontal until stopped by connector means 70. The below horizontal "use" position is illustrated in dashed lines in FIG. 6. Stage 12 can also be brought into an upwardly inclined "stow" position with a pull cord or the like (not shown) attached to the end of stage 12 opposite pivotable connector means 16. The pull cord on stage 12 can be operated by hand or with a winch. The upwardly inclined "stow" position is shown in dashed-and-dotted lines in FIG. 6.

Figure 5:
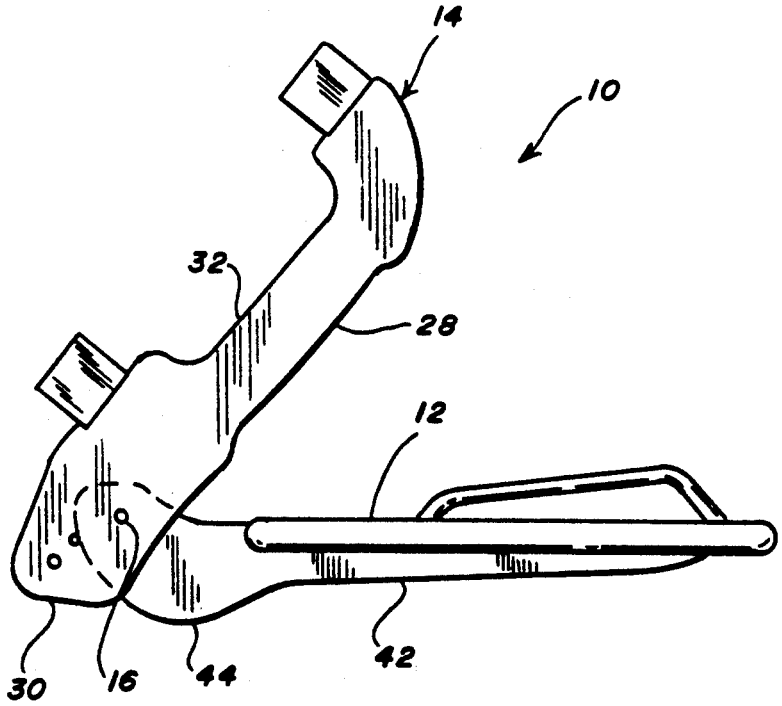
FIG. 5 is a side elevation view showing the boarding platform mounted on the bow of a large boat.

When mounting bracket 14 is oriented as shown in FIGS. 4 and 6, boarding platform 10 can be used with smaller pleasure wherein the slope of the hull at bow 22 is not particularly steep. With larger boats, however, the slope of the hull is steeper and mounting bracket 14 may be oriented as shown in FIGS. 5 and 7. For this purpose, the movement of elongated arm 42 is controlled by a second set of aligned holes in plates 48 - namely, holes 72, holes 74 and holes 60 (marked with circle B in FIGS. 6 and 7). A second pivot hole 76 in elongated arm 42 is provided. Hole 66 and hole 76 are vertically displaced from each other along an axis perpendicular to the long axis of elongated arm 42. Pivotable connector means 16 passes through pivot hole 76 in one end of the elongated arm and through aligned holes 60 in plates 48. Connector means 70 is through holes 74 in plates 48. When stop means 68 is in a pair of aligned holes 72 in plates 48, stage 12 is in the generally horizontal "use" position as shown in full lines in FIGS. 5 and 7. When stop means 68 has been pulled, the end of stage 12 drops until stopped by connector means 70 in holes 74 as shown in dashed lines in FIG. 7. Stage 12 can be brought into upwardly inclined "stow" position as shown in dashed-and-dotted lines in FIG. 7.

In use, when stage 12 is in its upwardly inclined "stow" position, the stage does not interfere to any great extent with the flow of water over the bow of the boat. When stage 12 is in its generally horizontal "use" position, a user may sit on the deck of the boat and use stage 12 as a foot rest or as a place to store fishing tackle or the like. Stage 12 can be used as a boarding step or a place from which a rescue operation can be effected. When stage 12 is stopped below its generally horizontal "use" position, stage 12 can be used as a boarding step to a low dock or a natural docking area.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A bow boat boarding platform for attachment to a bow of a boat having a bow eye, said boarding platform comprising a Y-shaped mounting bracket and a stage upon which a passenger can stand or use as a step, means for attaching the mounting bracket to the bow eye and pivotable connector means for attaching said stage to said mounting bracket, said connector means accommodating selective placement of the stage in an upwardly inclined "stow" position and in a generally horizontal "use" position while said stage is attached to the mounting bracket by said connector means.

2. The boarding platform of claim 1 wherein the mounting bracket has a pair of spaced apart arms cradling the bow, said arms joined by a leg with an elongated slot for receipt of the bow eye whereby the mounting bracket has a limited range of movement up and down the bow.

3. The boarding platform of claim 2 wherein one end of the leg has an attached head and the pivotable connector means for attaching the stage pass through the head.

4. The boarding platform of claim 3 wherein the stage is supported on an elongated arm with an elbow and wherein the leg is formed from a pair of plates, said elbow fitting snugly between the plates in said head portion.

5. The boarding platform of claim 3 wherein the stage, the elongated arm and a flange attached to the arm together form an I-beam for reinforcing the stage.

6. The boarding platform of claim 5 wherein support ribs and a cross brace are attached to elongated arm and to the underside of the stage.

7. A bow boat boarding platform for attachment to a bow of a boat having a bow eye, said boarding platform comprising a Y-shaped mounting bracket, a stage upon which a passenger can stand or use as a step, means for attaching the mounting bracket to the bow eye and pivotable connector means for attaching the state to the mounting bracket, said connector means accommodating selective placement of the stage in an upwardly inclined "stow" position and in a generally horizontal "use" position while said stage is attached to the mounting bracket by said connector means, said y-shaped bracket formed from a pair of parallel, spaced apart arms cradling the bow and a leg formed by a pair of plates with a head, said leg having an elongated slot along one side for receipt of the bow eye whereby the mounting bracket has a limited range of movement up and down the bow, said stage supported by elongated arm with an elbow which fits snugly between the plates in the head portion of the leg, said pivotable connector means passing through the elbow and through the plates in the head of the leg.

8. The boarding platform of claim 7 wherein a pair of spaced apart pivot holes are provided in the elbow and two sets of spaced apart aligned holes are provided in the plates forming the head of the leg, said pivotable connector means passing through one of the holes in the elbow and through a pair of holes in each of the sets whereby the boarding platform can be mounted head up or head down on the bow to accommodate a wide range of boats with hulls of varying hull slope and height.

9. The boarding platform of claim 7 wherein a stop means between the plates forming the head holds the stage in the generally horizontal "use" position.

10. The boarding platform of claim 8 wherein a pin in one pair of holes in the first set of holes in the plates forming the head holds the stage in the generally horizontal "use" position when the mounting bracket is mounted head up on the bow and said pin in one pair of holes in the second set of holes in the plates holds the stage in the generally horizontal "use" position when the mounting bracket is mounted head down on the bow.

11. The boarding platform of claim 10 wherein connector means pass through the pivot holes in elbow not in use by the pivotable connector and through one pair of holes in the plates for stabilizing the plates forming the head.

12. The boarding platform of claim 11 wherein a means is provided for pulling the pin holding the stage in the generally horizontal "use" position and wherein the connector means serve as stop means preventing the stage from falling substantially below said horizontal "use" position.

* * * * *